US005538747A

United States Patent [19]

Mueller

[11] Patent Number: 5,538,747

[45] Date of Patent: Jul. 23, 1996

[54] METHOD AND APPARATUS FOR THE CONTINUOUS DAMPING OF GRAIN

[75] Inventor: Roman Mueller, Niederuzwil, Switzerland

[73] Assignee: Buehler AG, Switzerland

[21] Appl. No.: 204,393

[22] PCT Filed: Jul. 27, 1993

[86] PCT No.: PCT/CH93/00189

§ 371 Date: Jun. 22, 1994

§ 102(e) Date: Jun. 22, 1994

[87] PCT Pub. No.: WO94/03274

PCT Pub. Date: Feb. 17, 1994

[30] Foreign Application Priority Data

Jul. 30, 1992 [CH] Switzerland ..... 02411/92

[51] Int. Cl.[6] ..... B05C 9/00

[52] U.S. Cl. ..... 426/507; 426/231; 426/460; 426/506; 99/487; 99/516; 99/534; 99/468; 99/483; 118/17; 118/19; 118/303; 366/151.1

[58] Field of Search ..... 426/231, 443, 426/450, 506, 507, 460; 99/485–488, 489, 516, 534, 536, 468, 471, 473, 483; 118/17, 19, 303; 366/153, 154, 156, 167, 168

[56] References Cited

U.S. PATENT DOCUMENTS

| | | | |
|---|---|---|---|
| 4,055,673 | 10/1977 | Mueller et al. | 426/231 |
| 4,987,850 | 1/1991 | McCracken | 118/303 |
| 4,994,286 | 2/1991 | Greer | 426/231 |
| 5,194,275 | 3/1993 | Greer | 426/231 |

FOREIGN PATENT DOCUMENTS

| | | |
|---|---|---|
| 0346278 | 12/1989 | European Pat. Off. . |
| 2540746 | 8/1984 | France . |
| 2503383 | 12/1982 | Germany . |
| 640750 | 3/1979 | Switzerland . |
| 1122770 | 7/1967 | United Kingdom . |

*Primary Examiner*—Esther M. Kepplinger
*Assistant Examiner*—Milton I. Cano
*Attorney, Agent, or Firm*—Finnegan, Henderson, Farabow, Garrett & Dunner

[57] ABSTRACT

The invention proposes the damping of grain, for example, by creating a rotating layer (20) in a damping chamber (2) with the help of acceleration rotors (3). For this, the cross-section of the rotation chamber is designed to form an outer boundary around two or, preferably, three acceleration rotors (3, 3', 3"). In this way, the rotating layer is forced into an eccentric and spiralling motion within the damping chamber (2). Damping is carried out in a very gentle manner, so that there occurs hardly any abrasion and no grain damage. Additional advantages include a longer and controllable reaction period during damping, optimized preparation for milling and a shorter, controllable tempering period.

20 Claims, 6 Drawing Sheets

METHOD AND APPARATUS FOR THE CONTINUOUS DAMPING OF GRAIN

BACKGROUND OF THE INVENTION

The invention relates to a method and a mechanism for the continuous damping or hydration of free flowing foodstuffs and animal feed, such as grain and milled grain products, as well as the use of a damping machine.

The wetting of free flowing foodstuffs and animal feed is subject to at least two special requirements. Firstly, it is important that a fairly small quantity of wetting agent, usually water or steam, is uniformly mixed with a large quantity of dry material. The second requirement is that the wetting agent should be distributed to each particle or individual grain and cover the entire surface thereof. In some applications, water is added simply to increase the water content, although, usually, the intention is to exert, or trigger, a favourable physical or biochemical influence on subsequent processing by creating favourable process conditions. The historical background to the practice of damping grain prior to milling, as seen over the past 100 years, is most interesting. According to the German patent specification No. 77 903, for example, at the start of industrial milling the main concern was the correct dosage of water for a given cereal throughput. Since then, the so-called damping screw with a screw conveyor rotating slowly in a trough and a water metering device located in the inlet area, has proved the most successful method which, in some instances, has remained in use to this day. Such damping screws can still be found in older mills. According to the German patent specification No. 1 094 078, efforts were made, for a considerable period of time, to simultaneously introduce some thermal treatment by steam action. Numerous tests have shown that, with some types of wheat, the introduction of moisture and heat has a positive effect on subsequent processing. However, as mill output and electrical energy costs rose, the heating and subsequent cooling of large quantities was no longer viable on account of the electrical energy consumption. Surprisingly, milling practice confirmed over many decades that the uniformity of water distribution on individual grains is not of prime consideration at the time the water is added, since experience has shown that 1 to 2 days of reaction time in the so-called tempering bin completely compensates for any initial distribution deficiencies of the damping water. The water penetrates the outer layers to optimize the internal part of each grain for subsequent milling.

Up until 20 years ago, to achieve a high degree of purity of the grain, it was common practice to wash the grain in a proper wash process, which served to remove stones at the same time. The high water consumption rate of 1 to 2 liters/kg of grain created enormous waste water problems which led, ultimately, to the development of the dry destoner. Thus, any heat treatment was frustrated by the high cost of electrical energy and washing by the cost of the wash water. Complete dry cleaning and damping in accordance with the applicant's German patent specification No. 25 03 383 has become the most widespread method in the past ten years. Damping water distribution is all the more homogenous, the more intensively the grain is mixed with the water and worked during damping. At the same time this method has the disadvantage of causing more grain damage and more abrasion. A water addition system should dampen the grain without causing abrasion. The water addition system should be designed so that the water acts on the grain to optimize it for subsequent milling. As far as damping is concerned, this has turned into a conflict of objectives.

SUMMARY OF THE INVENTION

The object of the invention is to achieve improved and more even damping of free flowing foodstuffs and animal feed, such as whole cereal grains, with low abrasion or damage to the grain.

The invention provides a method in accordance with one embodiment in that a metered liquid component is added to the grain flow and that at least two parallel acceleration rotors force the rotating mixed material layer (fluidised bed) into an eccentric motion within the damping chamber which is of similar shape to the rotors.

The invention has led to the surprising discovery that even a minimal increase in the dwell time of the mixture in the damping chamber produces several positive effects. The notion of a rotating layer (fluidised bed) in a damping chamber permits a previously impossible reaction time-through a suitable choice of dimensions within a relatively wide range. The use of at least two acceleration rotors and a surrounding damping chamber of similar shape to the rotors results in a preparation method which is much gentler on the product, so that grain damage and abrasion are noticeably reduced. There is optimum distribution of damping water all over the grain. Despite a substantially longer dwell time, the reduced intensity of mechanical action means that the power consumption per ton is no greater, whilst the wear on machinery components in direct contact with the product is reduced. Most important is the observation that in the case of known damping machines with a circular cross-section of the damping chamber, there occurs only relatively little exchange between a layer close to the wall and product closer to the centre, unless forced by appropriate beater action. On the other hand, it has been found that non-circular motion, in accordance with the principle of this invention, leads to maximum exchange between inside and outside layers without the need for much beater action from the acceleration rotors. Since this results not only in a preferred product flow in the rotating layer, but also a corresponding air flow, the damping effect is improved by a surprising number of forces. These include for example:

- acceleration forces emanating from the acceleration rotors
- frictional forces from the wall of the damping chamber
- centrifugal forces from the continual deflection in the corner areas
- gravitational force
- pneumatic forces
- as well as forces between the particles and forces from the rotating movements of the particles.

In this way it was possible to achieve, in a loose fluidised bed and with a minimum of mechanical beater action, a maximum effect regarding homogenous damping, distribution of damping water and damping action with minimal abrasion and without grain damage.

The invention permits also a number of particularly advantageous embodiments. The damping chamber is designed with rounded corners where the acceleration rotors accelerate the rotating mixed material layer, and where the flow of mixed material is conveyed into the damping chamber, preferably by force. Very careful damping is made possible by the acceleration rotors accelerating the rotating layer in the same direction and at roughly the same rotational speed. The acceleration rotors are advantageously arranged at a distance above each other without engaging in each other. The acceleration rotors force the mixture into a spiralling motion within the rotation chamber. This imposes a definable spiralling motion on the mass of grain, so that each individual grain dwells in the chamber for roughly the same amount of time. The acceleration rotors work together as it were, in that they jointly maintain the rotational motion. Despite this, and due to the gently curving shape of the chamber, there occurs an unexpectedly high transverse movement of individual grains. As each grain alternates between faster and slower motions, a hardly surpassable homogenous distribution of damping water is achieved, accompanied by strong penetration into the grain husks, since rotors and rotation chamber match each other.

In a particularly advantageous embodiment it is proposed that three acceleration rotors, with at least one of the acceleration rotors offset in height, accelerate the mixed material in the rotation chamber 3, which has a triangular cross-section, so that the acceleration rotors force the rotating mixed material layer into a corresponding triangular recirculating track. The rotation chamber encompasses the acceleration rotors in the corners with curved walls. These form an angle of about 90°–180° and surround the rotors. That causes the rotating mixed material layer to be accelerated in the area of the curved walls and decelerated in the area of the straight walls. It has been found that this measure promotes strong transverse movement of the grains, which enhances the mixing effect still further, since the forces acting on the grain in the areas of the straight chamber walls differ from those in the areas of the curved chamber walls. In the area of the straight wall sections, frictional forces acting on the grains which contact the wall and slide down it have a slowing-down effect of the grain motion. It is possible to arrange the rotors with an inclined or a vertical axis. However, rotors used in the dampening of grain prior to milling, are preferably arranged horizontally so that the product moves in a spiralling horizontal motion from an inlet to an outlet in the rotation chamber. In that way, the gravitational force has an additional mixing effect. The bottom acceleration rotor preferably assumes a forward position in relation to the rotating chamber and forms an inlet for the grain and the liquid component so that the grain is already mixed outside the rotation chamber and the mixed material is force-fed into the rotation chamber. In addition, it is proposed to control the dwell time of the mixed grain material in the rotation chamber with a level control slide in the area of the outlet. It is thus possible to select or control the thickness of the rotating layer, that is to say the quantity of the rotating mixed material and, correspondingly, the reaction time within the rotation chamber. This permits extremely gentle damping of less resistant types of cereal which may possibly need a slightly extended tempering time. In applications where a high percentage of water needs to be added, the grain can be dampened in two or three damping chambers connected in series.

In another particularly advantageous embodiment, grain intended for the production of milled products, such as wholemeal flours, white flours, middlings and semolina, can be prepared for milling by bringing it to the required moisture level through the metered addition of water of, say, 2 to over 7% before transferring it to a tempering bin and subsequent milling. Prior to tempering, the cereal is, preferably, cleaned first in a dry stage and then in a damp or wet stage, wherein the main quantity of water of 2–7% or more is added either before or during the second stage, and the grain is, preferably, left to steep for 1 to 120 minutes prior to the damp or wet cleaning process. The grain is, preferably, subjected to surface preparation during the damp or wet cleaning process with part of the outer husk removed by abrasion and the abraded material immediately separated from the grain, wherein, preferably, 0.2 to 2% is removed from the grain by abrasion and the grain is subjected to scouring, preferably, in the dry cleaning phase, whilst avoiding any removal of the husks by abrasion. In addition, it is proposed to measure the corn moisture level after damping or after the damp or wet cleaning process, compare it with a reference value by computational means and correct the addition of water through suitable means of control. The new method of preparing grain for milling is especially advantageous in a mill situation, where the grain is prepared in the damping chamber for at least 10 seconds to 3 minutes before being left to steep for 10 to 120 minutes in a tempering bin. From this results a positive combination of reactions. Reduced abrasion during damping inhibits the multiplication of harmful microbes. The improved damping effect permits a reduction in the tempering period to less than half an hour, or only a few hours. Prior to damping, the grain is subjected to intensive scouring and fresh cleaning after the tempering period.

The invention also provides an apparatus as set out in another embodiment that is to say damping apparatus for foodstuffs and animal feed, for example grain and milled grain products, which features at least two parallel rotors, and which is characterized in that the rotors are designed as acceleration rotors and surrounded by a damping chamber of a similar shape to the rotors. The damping chamber can have an elliptical or elliptical-like shape, with an acceleration rotor arranged in the area of each focal point, if two acceleration rotors are used. In a particularly favourable embodiment of the invention, the recirculation damping chamber is of triangular shape with an acceleration rotor arranged in each corner which is of similar shape to the rotor. The use of two acceleration rotors is quite adequate for smaller throughput rates. Three acceleration rotors, on the other hand, offer an unexpectedly wide application range since both the dwell period, as well as the throughput rate and the amount of wetting agent, can be varied over an enormously wide range. Acceleration rotors are preferably arranged horizontally with one acceleration rotor lower than the other. It has also been found to be very advantageous when one acceleration rotor is extended to serve as a feed conveyor, and protrudes beyond the recirculation damping chamber, and features an inlet for the grain, as well as the liquid component. The feed conveyor can be designed as a pre-mixer with conveying elements for the forced intake into the recirculation damping chamber. It is also possible to arrange a further feed element in the central area, parallel to the acceleration rotors, for the introduction of at least one more dry or liquid component. An adjustable level control slide is arranged in the area of the outlet in order to control the throughput rate and dwell period. A first acceleration rotor is connected to a drive unit. The other acceleration rotors can then be driven by the first rotor via a transmission system, and preferably at the same rotational speed. The invention also allows the use of the damping apparatus for the admixture of sugar, starch, gluten, vitamins, oils, fats etc. to a grain or milled grain product.

BRIEF DESCRIPTION OF THE INVENTION

The accompanying drawings, which are incorporated herein and constitute a part of the specification, illustrate presently preferred embodiments of the invention and, together with the general description given above and the detailed description below, serve to explain the principles of the invention.

Figure 1:
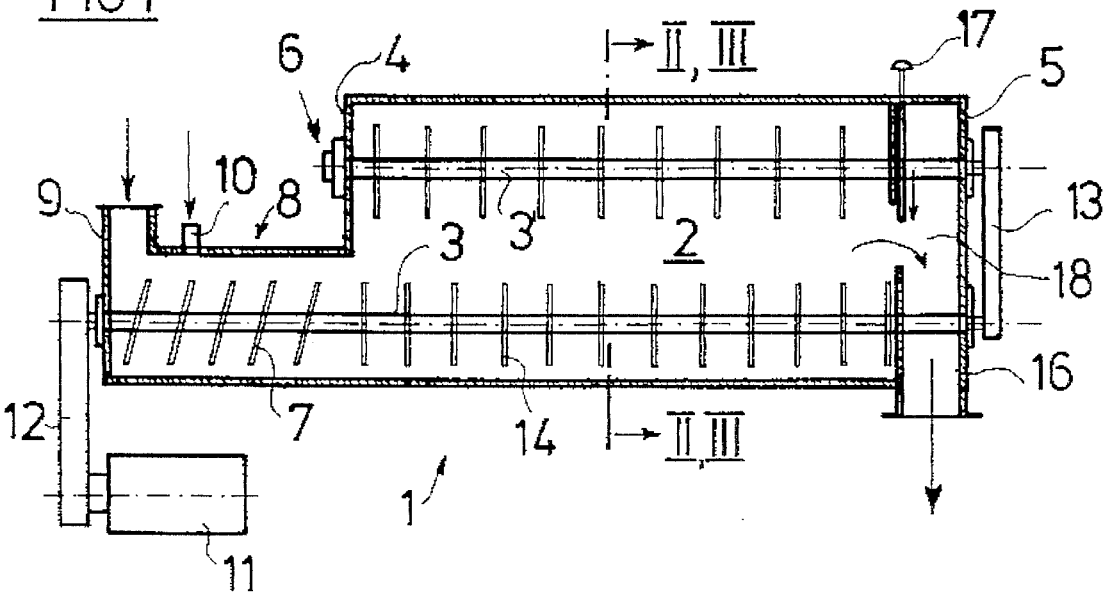
FIG. 1 shows a longitudinal section through a damping device or machine.
Figure 2:
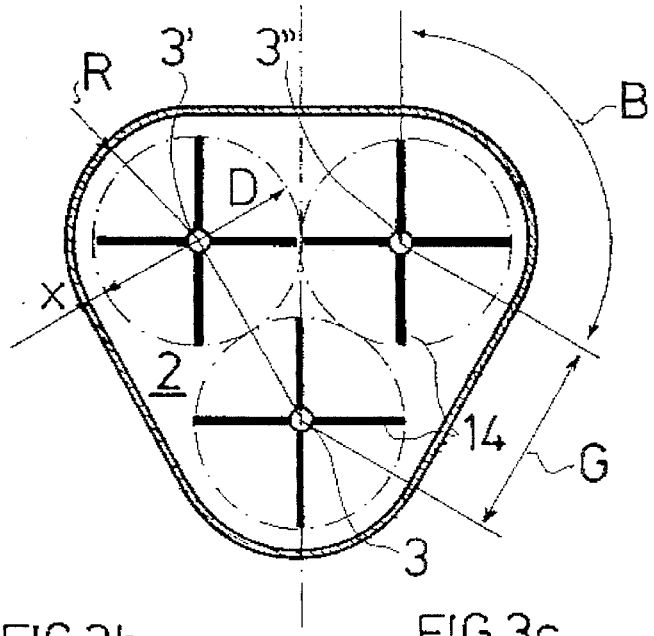
FIG. 2 shows a section II—II of FIG. 1 with three acceleration rotors.
Figure 3A:
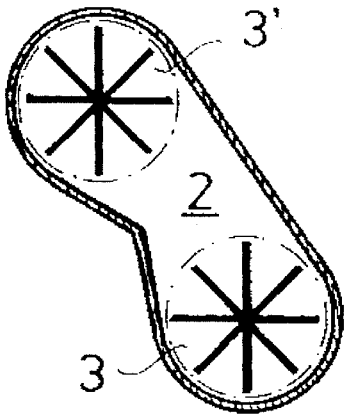
Figure 3B:
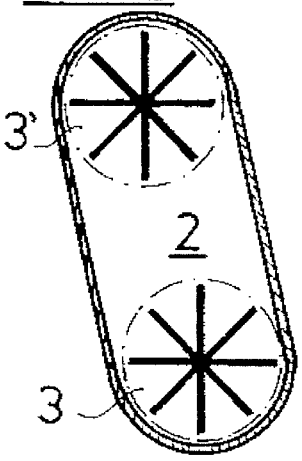
Figure 3C:
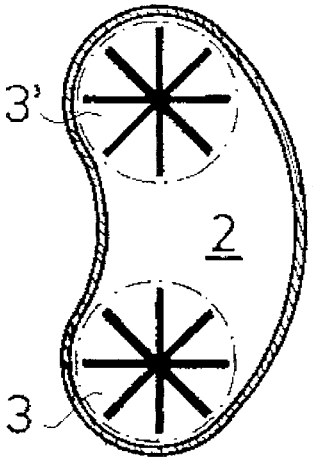
Figure 4:
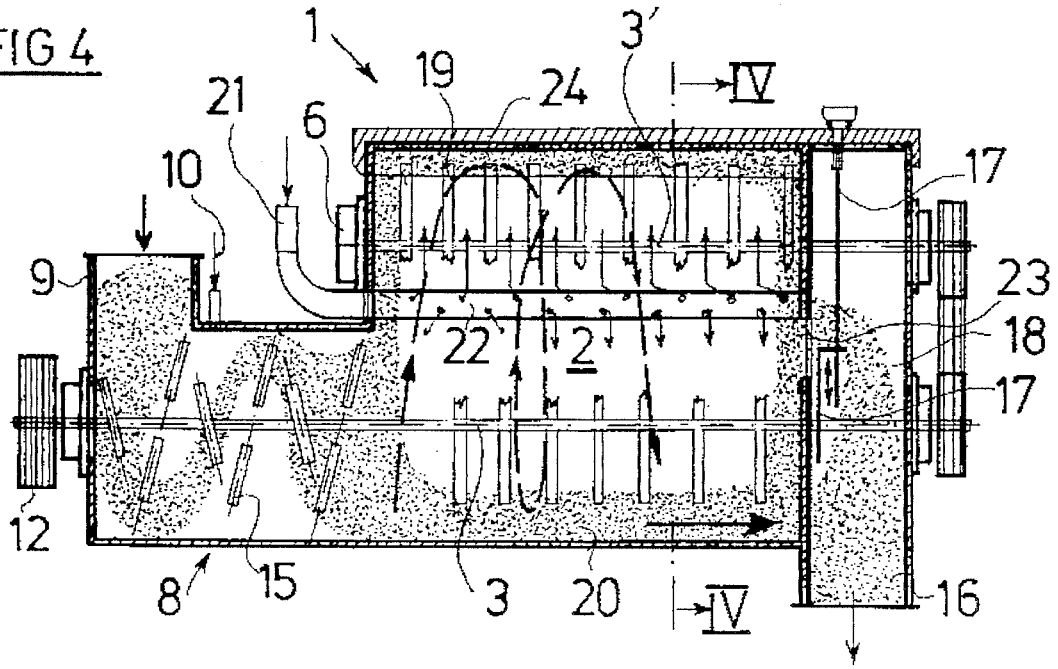
Figure 4A:
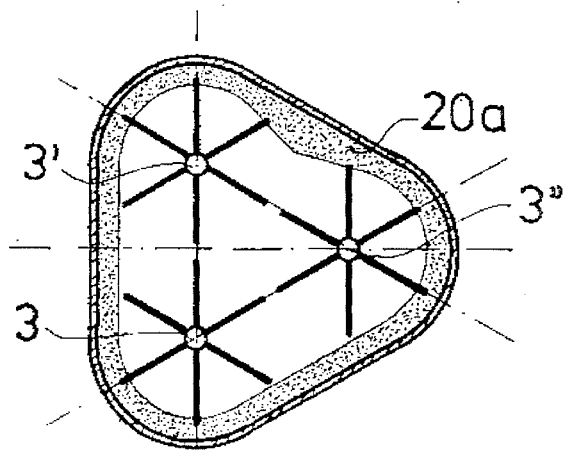
Figure 4B:
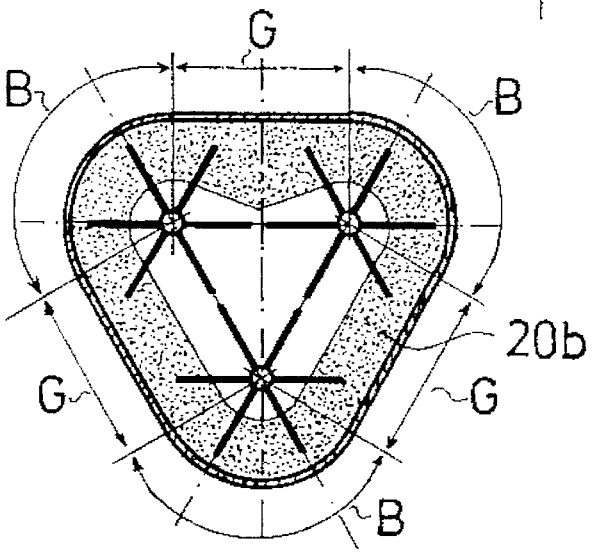
Figure 4C:
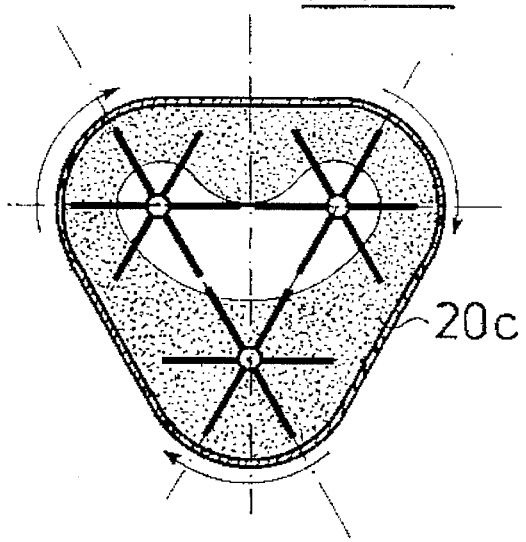
Figure 5A:
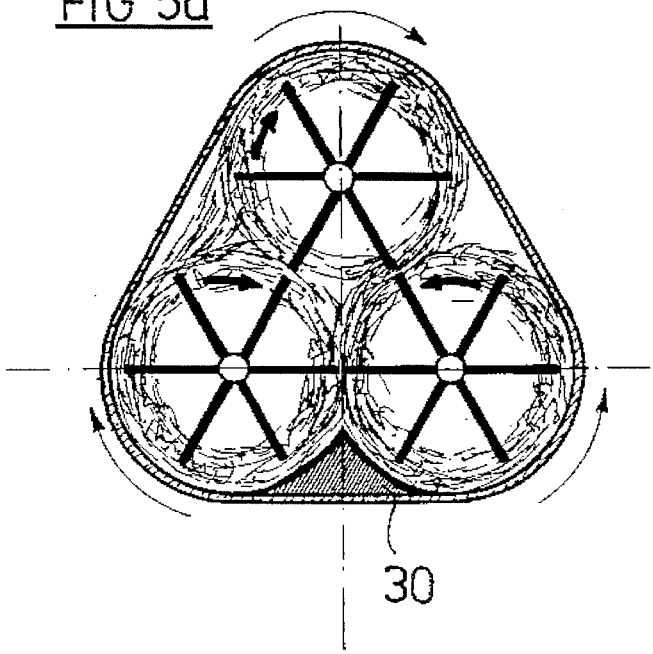
Figure 5B:
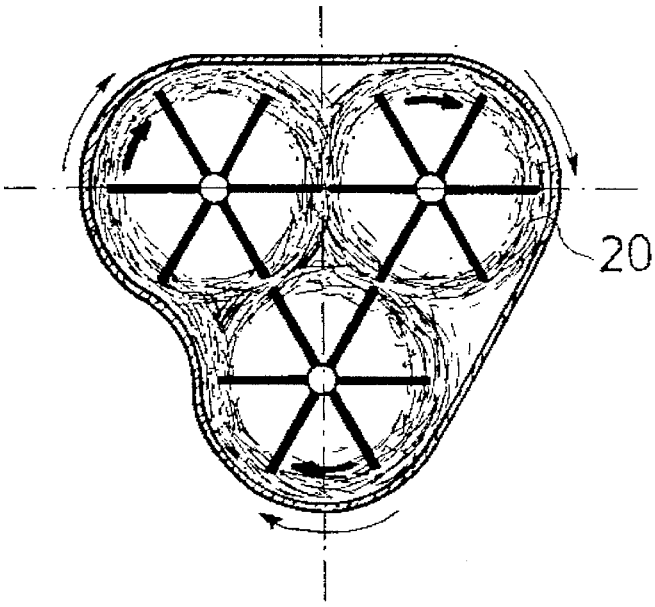
Figure 5C:
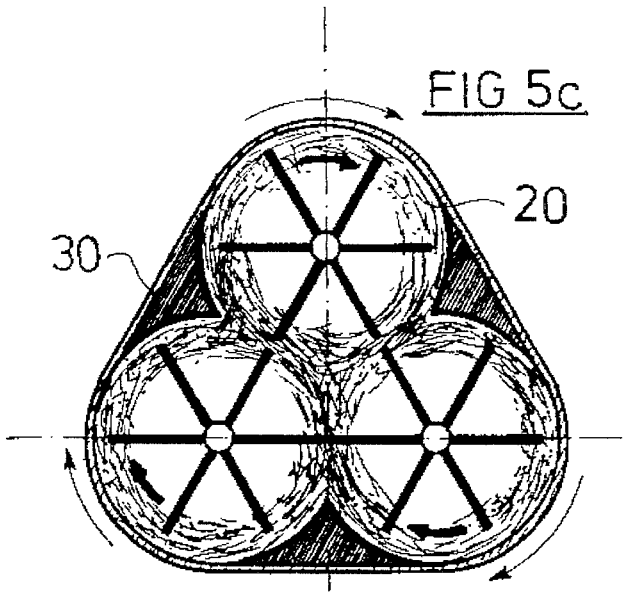
Figure 6:
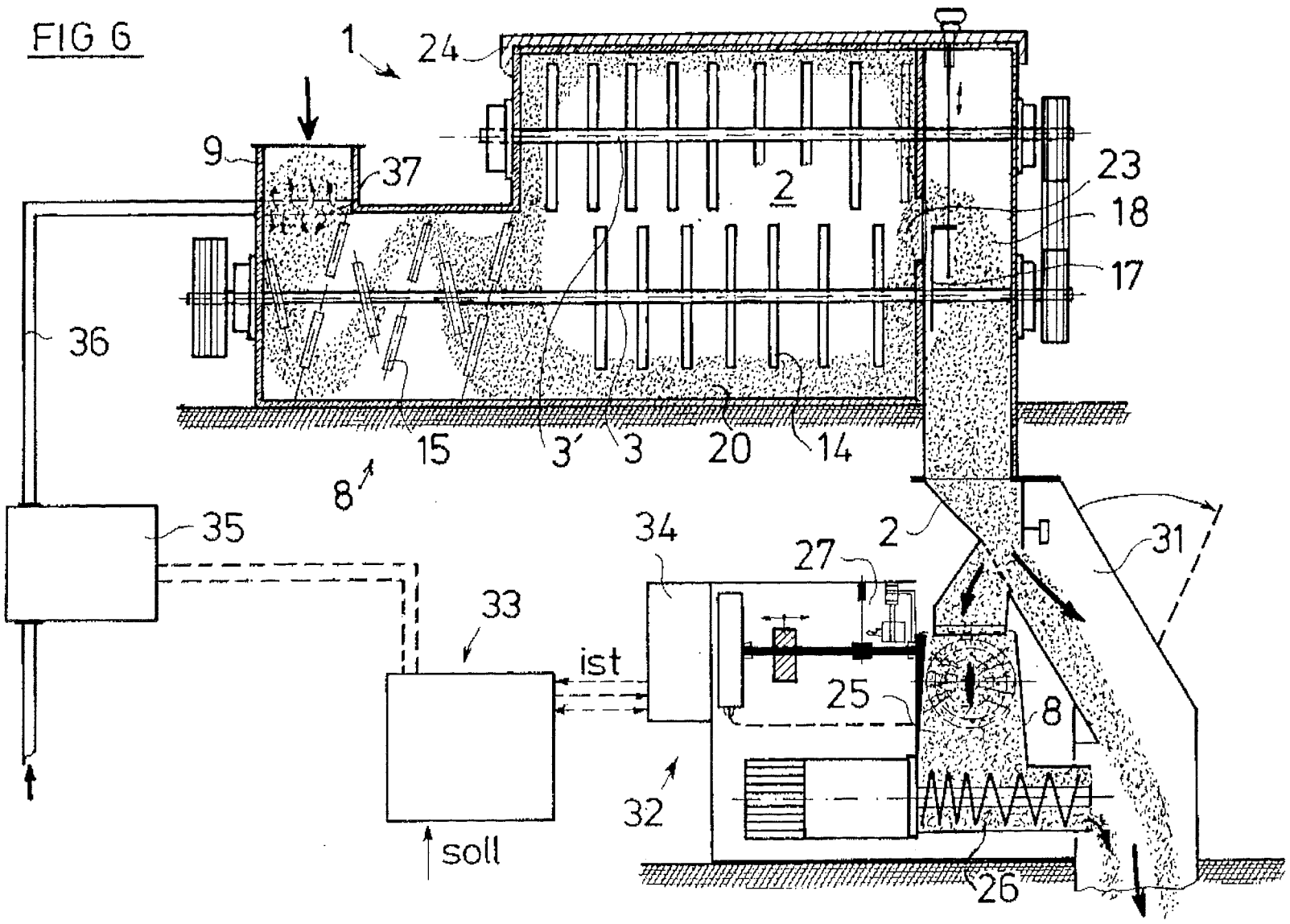
Figure 7:
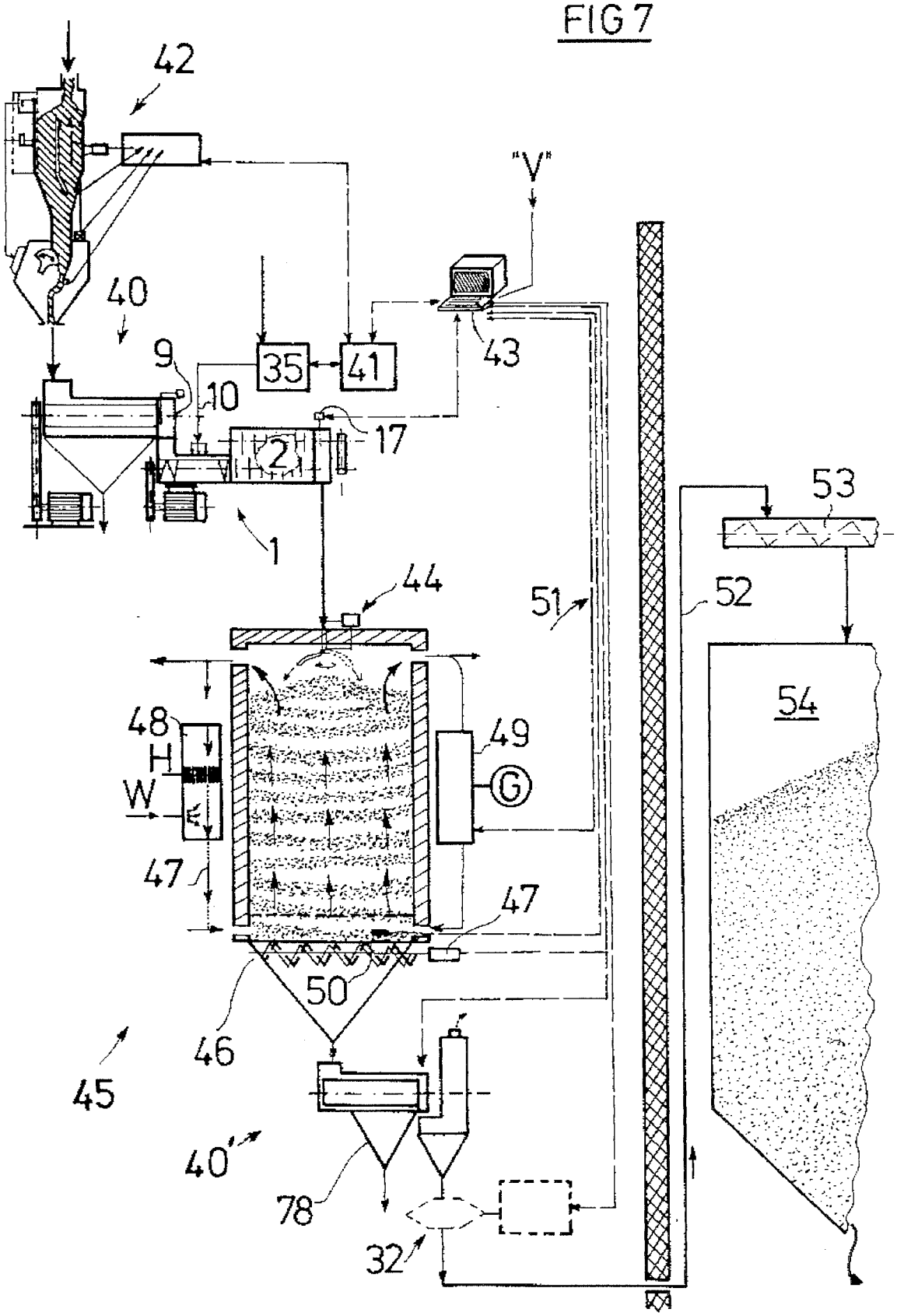
Figure 8:
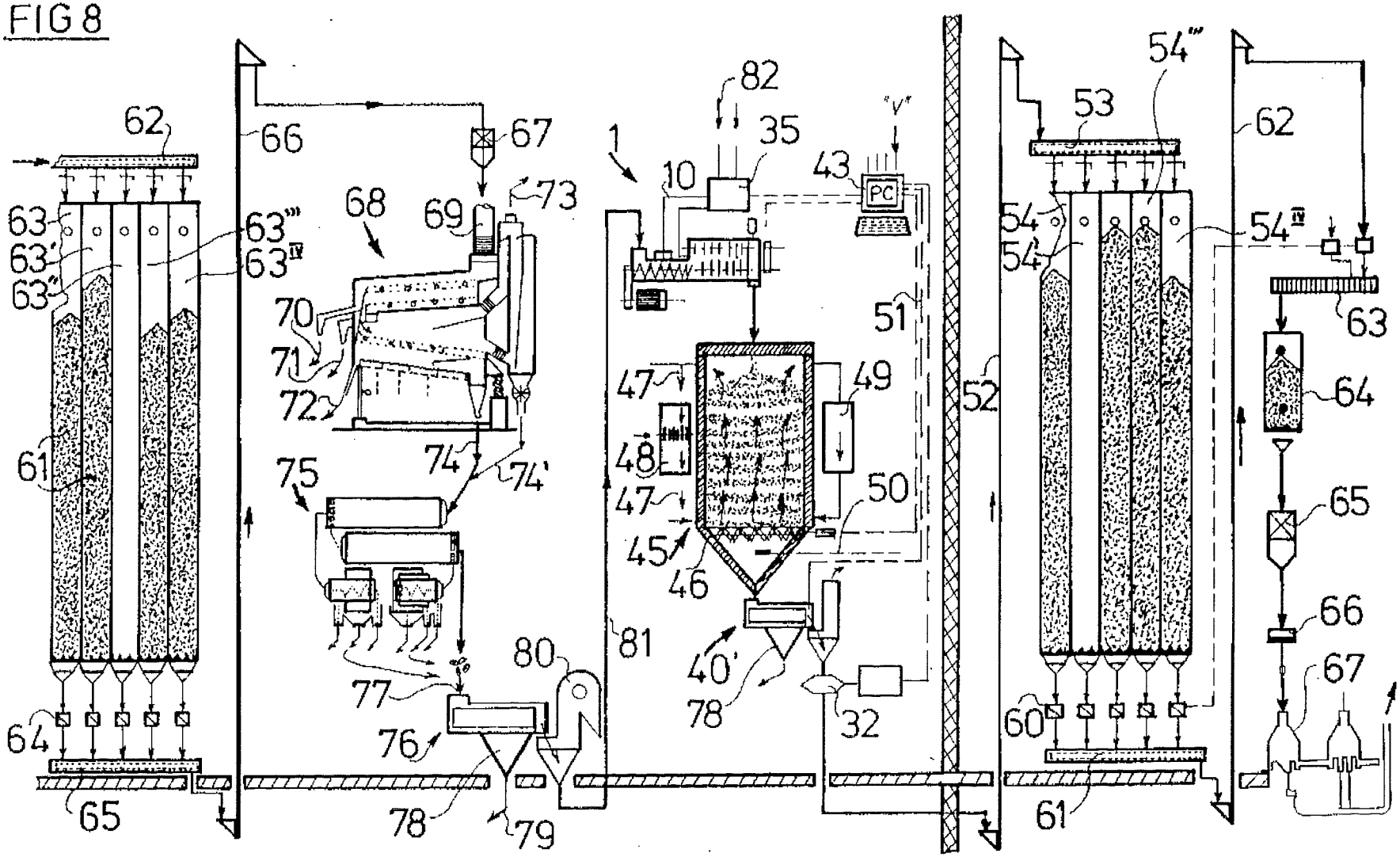

FIGS. 3*a*, 3*b* and 3*c* show variants of FIG. 2 in accordance with section III—III of FIG. 1 with two acceleration rotors each;

FIG. 4 shows a longitudinal section of the damping machine with a spiralling product motion;

FIGS. 4*a*, 4*b* and 4*c* show a section IV—IV of FIG. 4 each with a different control level;

FIGS. 5*a*, 5*b* and 5*c* show different embodiments of the damping machine in cross-section;

FIG. 6 shows, in schematic form, the damping of grain and subsequent measurement of the corn moisture level including control of the damping water feed;

FIG. 7 shows a controlled damping of grain with subsequent intermediate storage;

FIG. 8 shows a complete grain cleaning and damping process in preparation for milling.

DETAILED DESCRIPTION OF THE DRAWINGS AND THE INVENTION

In the following description reference is made to FIGS. 1 and 2. A damping machine 1 features a damping chamber 2 in which acceleration rotors 3, 3', 3" are arranged in parallel and mounted in pivot bearings 6 at a front wall 4 and an end wall 5. Two acceleration rotors 3' and 3" are arranged in the upper section of the damping chamber 2 and one acceleration rotor 3 in the lower section (FIG. 2). The lower acceleration rotor 3 is designed to protrude with an extension in the area of the front wall 4. Screw type conveying elements 7 form a forced intake system or feed conveyor 8. The material to be dampened is introduced through an inlet 9 as a continuous product flow, and the wetting agent is introduced through a pipe section or sleeve 10. Depending on specific requirements, the two flows (product + wetting agent) should be carefully matched and metered. An electric motor 11 drives, via a belt system 12, the lower acceleration rotor 3 which, in turn, drives the two upper acceleration rotors 3' and 3" through a transmission system 13. Depending on their application requirements, the acceleration rotors 3, 3' and 3" feature differently shaped or differently set rotating blades 14 of essentially known design and more or less in accordance with the German patent specification No. 25 03 383. Corresponding to the three acceleration rotors 3, 3', 3" the damping chamber 2 is of triangular cross-sectional shape and comprises three curved wall sections B and three straight wall sections G, with every two straight wall sections describing an angle of 120°. Depending on individual requirements, it is possible also to select completely different triangular shapes, including irregular triangular or rectangular shapes. Rectangular shapes involve the use of four acceleration rotors, however, one in each corner. The curved wall section B is arranged at a distance, that is to say with a clearance (x), from the tips of the blades 14. The corresponding radius R is consequently greater by an amount of X than half the acceleration rotor's diameter D, thereby giving the casing a shape similar to an enveloping line about the acceleration rotors 3, 3' and 3".

As can be seen from FIGS. 3*a* to 3*c*, the use of only 2 rotors gives the damping chamber 2 an oval, elliptical or elliptical-like cross-sectional shape.

FIG. 4 shows the spiralling product flow 19 in a damping machine. The conveying elements 15 in the area of the feed conveyor 8 are designed as screw-like blades with a mixing function. The product leaves the damping machine 1 through a chute 16, via an outlet opening 18 in the damping chamber 2 the cross-section of which can be adjusted by means of a level control slide 17. The control slide 17 serves to preset the product level in the damping chamber. FIG. 4*a* shows the flow pattern for a very low control level, FIG. 4*b* for a medium control level and FIG. 4*c* for a maximum control level. The flow patterns shown assume that all three acceleration rotors rotate in the same direction, that is to say in clockwise direction according to FIGS. 4*a* to 4*c*. It is interesting to note that in each case a correspondingly thicker or thinner rotating fluidised layer 20*a*, 20*b* and 20*c* is formed. As can be seen from FIGS. 4*a*, 4*b* and 4*c* respectively, the damping chamber 2 can be used in different positions of attitude since, unlike the old gravity mixing drums, this new arrangement is a mixer particularly based on acceleration. This knowledge has led to further specific embodiments as illustrated in FIGS. 5*a* to 5*c*. Tests have shown that, subject to the choice of suitable dimensions for the damping chamber 2, and the choice of a suitable rotational speed for the acceleration rotors 3, it is also possible to fit one or more guide(s) 30 for the special guidance of the rotating layer 20. In addition, one of the three rotors can even be arranged to rotate in the opposite direction, as shown in FIG. 5*a* for example. The product guide(s) 30 is/are of special significance in applications with mixing problems, that is to say, when mixing flours with liquid and/or fatty components for example. In this case, a feed pipe 21 can be provided in addition to the inlet 9 and the sleeve 10, which feed pipe ends, preferably with a distribution pipe 22, more or less in the centre of the damping chamber 2, all in accordance with FIG. 4. Thus it is possible, for example, to add sugar, starch, gluten, vitamins, improvers, pickling agents, oils, fats, molasses, acids etc. through the central distribution pipe 22. This has the advantage that the often very sticky substances are sprayed straight onto the rotating layer without coming into direct contact with the wall surfaces. For such applications, the entire damping machine can be either cooled or heated by means of a thermal jacket 24.

Reference is now made to FIG. 6. A damping machine 1 is connected by its outlet 18 direct to a main product duct 31. A microwave measuring device 32 for measuring the bulk weight is suspended from a beam 27 in the manner of scales and measures the moisture level of the product in a bypass 25. A discharge screw 26 scrolls the product continuously back into the main product duct 31. The microwave measuring device 32 is connected to a monitoring instrument 33 so that the respective measurement signal from a control unit 34 can be evaluated by the variance detection method and transmitted as a control signal to a water metering unit 35. The latter regulates the amount of water introduced into the free flowing bulk material through a water pipeline 36 and a water injection tube 37. The water metering system according to FIG. 6 is based on the feedback method of control. This method of control is particularly advantageous when the water content of the raw grain is more or less known and when no major fluctuations are expected in the moisture level of the grain and/or the throughput rate through the damping machine. The dwell period in the damping machine 1 can be controlled by adjusting the cross-section of the outlet 23 from the damping chamber 2.

FIG. 7 shows another particularly advantageous embodiment of the invention for damping grain in preparation for milling. The preferred mechanism for this is a damping machine 1 in accordance with FIGS. 1 or 2. A scourer 40 is connected in series upstream from the damping machine to remove all loose dirt and husk particles from the grain. The dry grain is conveyed into the damping chamber 2 through the inlet 9. The amount of damping water is introduced by a water metering unit 35. An external electronic unit 41 receives the desired values "V" from a moisture measuring instrument 42 and a computer 43. The moisture meter can be designed according to EP specification No. 43 137. A rotary distributor 44 evenly and uniformly distributes the freshly dampened wheat in a buffer hopper 45. A vibratory discharge device 46, activated by a drive motor 47, ensures a uniform and even discharge flow and transfers the-product in a metered manner to a second scourer 40'. Thus, FIG. 7 represents a preparation-for-milling station which, fully recipe controlled, optimizes the damping and tempering phases under the best possible control conditions. For the first time it is now possible to fully control the preparation-for-milling process. In this connection it is possible to adjust the dwell period in the damping chamber 2 in accordance with the appropriate recipe, by means of the computer 43 and motor driven adjusters which act on the level control slide 17, as well as the dwell period in the buffer hopper 45. Another interesting embodiment concept provides for additional preparation in the buffer hopper 45 with conditioned air 47 from an air preparation system 48 with controlled temperature or heating "H" and humidity or water admixture "W", preferably by the recirculation method. In addition, it is also possible to create a special gas atmosphere in the buffer hopper 45, e.g. with $CO_2$, by means of a fumigator "G" or 49. The buffer hopper 45 could also be fitted with a recirculation system, although continuous operation is the preferred method. A sensor probe 50 is used to measure the temperature of the grain. In the same way it is possible to measure, once more, the effective corn moisture level after damp or wet cleaning, using a microwave measuring unit 32 for example. A data bus system 51 transmits both values to the computer 43, which co-ordinates all operations on the basis of overriding reference values "V". The grain in the buffer hopper 45 can be heated, or cooled, if necessary, to a constant temperature of, say, 20° C. The entire system permits whatever correction may be necessary after damp or wet cleaning, either through the air preparation system 48 or the damping machine 1. Having been cleaned and dampened to the highest standard, and using an elevator 52 and a distributing conveyor 53, the grain to be milled is subsequently transferred to a conditioning bin 54 where it is conditioned for, say, 6 to 12 hours, or up to 24 hours if necessary.

Reference is now made to FIG. 8. A distributing conveyor 62 transfers the so-called raw grain 61 into the respective raw-grain bins 63, $\mathbf{63}^{i}$ to $\mathbf{63}^{iv}$ etc. for preparation. The raw grain 61 consists of only partially cleaned grain or uncleaned grain. It is customary first to remove the worst contamination by sifting and aspiration without actually cleaning individual grains. In addition, the raw-grain bins 63 are used to make available different types of cereal which are subsequently mixed in preset quantities and percentages using a quantity regulator 64 and a collecting screw 65. The raw-grain mixture is then transferred, by means of an elevator 66 and a weigher 67, to the first pre-cleaning stage 68 of the dry cleaning system, which constitutes a combination of grading by size in the upper section and gravitational classification in the bottom section, as described in the EP specification No. 293 426 for example. The raw grain is fed via an intake 69 to the pre-cleaning stage 68 where larger foreign bodies, or coarse particles, are removed through an outlet 70, fine sand through an outlet 71, stones through an outlet 72 and fine dust through an exhaust duct 73. The grain is subsequently fed into a cockle cylinder (indented-type separator) 75 through a connecting duct 74 or 74'. The cockle cylinder 75 permits the removal of most foreign seeds, such as round grains and long grains, oats, barley, vetch etc., as well as cockles and broken grains. The grain to be milled is introduced, as main fraction, through an inlet 77, into a dry scourer 76 where the first intensive surface cleaning of individual grains takes place. The dry abraded material is removed through a collecting hopper 78 and a chute 79. A grain aspirator 80 subsequently removes any loose husks and, especially, abraded material before a conveyor 81 feeds the dry cleaned grain in a continuous manner into the damping machine 1. The damper 1 can be of any of the aforementioned design concepts, the important thing being that a carefully metered amount of damping water defined by a computer 43 is added from a suitable damping water supply 10, via a water metering unit 35. In addition, or instead of the water, steam may be introduced through a steam pipe 82 for damping the grain. The freshly dampened grain is left to steep in the buffer hopper 45 for at least 3 to 10 minutes, but not more than 120 minutes. After an adjustable period of time the grain is transferred, via a metering discharger, to a wet scourer 40' where, depending on actual application requirements, 0.2 to 2% of the grain is removed by abrasion, with the abraded material ducted away immediately above the collecting hopper 78. After standing in the conditioning bins 54, the grain to be milled is transferred, via flow control devices 60, a horizontal conveyor 61 and an elevator 62, to another damping machine 73 where 0.1 to 0.5% of water is added for the $B_1$ damping of the grain surface. After a short rest period in a $B_1$ bin 64, the mill input is measured with the so-called $B_1$ weigher 65. A magnetic safety separator 66 then transfers the grain to be milled to the first milling stage, or first roller mill 67. The milled grain products are subsequently obtained in the known manner, by the high-grinding method.

I claim:

1. A method for the continuous damping of free flowing foodstuff comprising the steps of:

providing a housing having a foodstuff inlet, a damping chamber communicating with the foodstuff inlet, and a foodstuff exit at the bottom of the damping chamber distant the foodstuff inlet, and at least two parallel acceleration rotors cooperatively disposed within the damping chamber;

forcing the foodstuff into the foodstuff inlet;

introducing a wetting agent into the housing;

mixing the foodstuff and wetting agent with the at least two parallel rotors in the damping chamber of the housing, the parallel rotors being offset from one another and one of the at least two parallel rotors being longer than the other and extending near the foodstuff inlet for moving the foodstuff away from the inlet and into the damping chamber section of the housing, the housing enclosing the parallel rotors and closely surrounding the outer periphery of the at least two parallel rotors in the damping chamber causing substantially all the foodstuff to be mixed with the wetting agent; and removing the dampened foodstuff from the exit.

2. The method of claim 1 further comprising the steps of:

guiding the dampened foodstuff into a moisture measuring means;

measuring the moisture in the foodstuff in the measuring means; and controlling the amount of wetting agent introduced into the damping chamber based upon the measured moisture.

3. The method of claim 1 further comprising the steps of:

cleaning the foodstuff prior to forcing the foodstuff into the foodstuff inlet;

measuring the moisture in the foodstuff in a measuring means after the dampened foodstuff exits the damping chamber;

controlling the amount of wetting agent introduced into the damping chamber based upon the measured moisture; and distributing the dampened foodstuff in a hopper for temporary storage.

4. The method of claim 3 further comprising the step of:

controlling at least one of temperature, humidity and residence time in the hopper.

5. An apparatus for the continuous damping of free flowing foodstuff comprising:

a housing having an inlet section and a damping chamber section;

a foodstuff inlet on the top of the inlet section of the housing;

a wetting agent inlet in the housing for introducing the wetting agent into the housing;

an exit in a bottom side of the damping chamber section of the housing for removing the dampened foodstuff; and at least two parallel rotors, the parallel rotors being offset from one another in height and the lower of the at least two parallel rotors being longer than the other and extending near the foodstuff inlet for moving the foodstuff away from the foodstuff inlet, the housing enclosing and closely surrounding the at least two parallel rotors for causing substantially all the foodstuff to be continuously moved in the damping chamber section of the housing and dampened.

6. The apparatus of claim 5 further comprising:

a feed pipe at the damping chamber section of the housing, the feed pipe extending parallel to and between the at least two rotors and having small openings therein for introducing an additive to the foodstuff.

7. The apparatus of claim 5 wherein the at least two rotors comprise three rotors and the three rotors are arranged in the shape of an inverted triangle.

8. The apparatus of claim 5 wherein damping chamber section of the housing further comprises three curved wall sections and three straight wall sections joined to form a triangle and each curved wall section having a rotor located therein.

9. The apparatus of claim 5 wherein the at least two rotors comprise exactly two rotors and the damping chamber section of the housing has an oval cross sectional shape.

10. The apparatus of claim 5 wherein the at least two rotors are rotated by a single drive means in the same rotational direction.

11. The apparatus of claim 5 wherein the three rotors are rotated by a drive means, the drive means rotating each of the three rotors in the same direction.

12. The apparatus of claim 5 wherein the three rotors are rotated by a drive means, the drive means rotating at least one rotor in a direction opposite the other rotors.

13. The apparatus of claim 5 further comprising guiding means located in the damping chamber section and within at least one area defined by a straight wall section of the housing and two rotors to direct movement of the foodstuff in the housing.

14. The apparatus of claim 5 wherein one straight wall section is concave shaped to provide a guiding means for directing the movement of the foodstuff in the housing.

15. The apparatus of claim 5 wherein the rotors do not engage one another.

16. The apparatus of claim 5 further comprising control means located near the exit for regulating the flow and level of foodstuff in the damping chamber.

17. The apparatus of claim 5 wherein the rotors are arranged horizontally.

18. A method for the continuous damping of free flowing foodstuff comprising the steps of:

providing a housing having a foodstuff inlet, a damping chamber communicating with the foodstuff inlet, and a foodstuff exit at the bottom of the damping chamber distant the foodstuff inlet, and at least two parallel acceleration rotors cooperatively disposed within the damping chamber and having an outer periphery, the portion of the housing defining the damping chamber being formed to enclose the parallel rotors and to closely conform to the outer periphery of the at least two parallel rotors;

forcing the foodstuff into the foodstuff inlet;

introducing a wetting agent into the housing;

mixing the foodstuff and wetting agent with the at least two parallel rotors in the damping chamber of the housing, the parallel rotors being offset from one another and one of the at least two parallel rotors having an elongated portion, the elongated portion of the at least one parallel acceleration rotor extending near the foodstuff inlet, said method including the step of moving the foodstuff into the damping chamber section of the housing using said elongated rotor portion; and removing the dampened foodstuff from the exit.

19. An apparatus for the continuous damping of free flowing foodstuff comprising:

a housing;

a foodstuff inlet at one end of the housing;

a wetting agent inlet in the housing for introducing a wetting agent into the housing;

an exit at another end of the housing for removing the dampened foodstuff; and at least two parallel rotors positioned within the housing, the parallel rotors being acceleration rotors and one of the at least two parallel rotors being longer than the other and extending near the foodstuff inlet for moving the foodstuff away from the inlet, the housing being formed to enclose the parallel rotors and to closely conform to substantially the entirety of an outer periphery of the at least two parallel rotors whereby substantially all the foodstuff is mixed with the wetting agent to dampen the foodstuff.

20. An apparatus for the continuous damping of free flowing foodstuff comprising:

a housing;

a foodstuff inlet at one end of the housing;

a wetting agent inlet in the housing for introducing a wetting agent into the housing; and an exit at another end of the housing for removing the dampened foodstuff; and at least two parallel rotors positioned within the housing, the parallel rotors being acceleration rotors and having portions cooperating to mix the foodstuff and water in the chamber, and one of the at least two parallel rotors having an elongated portion extending near the foodstuff inlet for moving the foodstuff toward the cooperating rotor portions, the housing being formed to enclose and to closely conform to substantially the entirety of an outer periphery of the cooperating portions of the at least two parallel rotors whereby substantially all the foodstuff is mixed with the wetting agent to dampen the foodstuff.

* * * * *